US005454138A

United States Patent [19]

Mondigo et al.

[11] Patent Number: 5,454,138

[45] Date of Patent: Oct. 3, 1995

[54] SQUEEGEE MOUNTING FOR FLOOR SCRUBBER

[75] Inventors: Jesse V. Mondigo, Northlake; Gary E. Palmer, Roselle, both of Ill.

[73] Assignee: Minuteman International, Inc., Addison, Ill.

[21] Appl. No.: 324,250

[22] Filed: Oct. 17, 1994

[51] Int. Cl.[6] ..... A47L 11/30

[52] U.S. Cl. ..... 15/354; 15/320; 15/401

[58] Field of Search ..... 15/320, 321, 245, 15/401, 373, 354

[56] References Cited

U.S. PATENT DOCUMENTS

| | | | |
|---|---|---|---|
| 3,065,490 | 11/1962 | Arones | 15/401 X |
| 3,376,597 | 4/1968 | Boyd | 15/401 X |
| 3,939,518 | 2/1976 | Whitney | 15/320 X |
| 4,339,841 | 7/1982 | Waldhauser et al. | 15/320 X |
| 4,483,041 | 11/1984 | Waldhauser et al. | 15/320 X |
| 4,492,002 | 1/1985 | Waldhauser et al. | 15/320 |
| 4,759,094 | 7/1988 | Palmer et al. . | |
| 4,803,753 | 2/1989 | Palmer . | |
| 5,239,720 | 8/1993 | Wood et al. | 15/401 X |
| 5,377,382 | 1/1995 | Bores et al. | 15/401 X |

*Primary Examiner*—Christopher K. Moore
*Attorney, Agent, or Firm*—Emrich & Dithmar

[57] ABSTRACT

An integral gimbal housing is trunnion mounted beneath and to the rear of the frame of a floor scrubber. The gimbal housing includes a vertical pivot shaft to which a yoke is mounted. A spring biases the gimbal housing to the use position. The yoke swings laterally and includes a rearwardly extending tubular receptacle which receives a forwardly extending tube of the squeegee so that the squeegee assembly has independent rotation about a horizontal axis and the squeegee adjusts to uneven surfaces. Torsion springs bias a vertical pivot shaft in the gimbal housing to the center position.

10 Claims, 3 Drawing Sheets

SQUEEGEE MOUNTING FOR FLOOR SCRUBBER

FIELD OF THE INVENTION

The present invention relates to floor scrubbing machines; and more particularly it relates to a floor scrubber having a "tracking" squeegee for suction recovery of spent liquid.

BACKGROUND OF THE INVENTION

Automatic floor scrubbing machines are well known in the art. One such machine is disclosed in U.S. Pat. No. 4,759, 094 which shows a self-propelled automatic floor scrubber having a powered brush in a forward location beneath the machine and a vacuum recovery system at the rear end of the machine behind the brush. Cleaning fluid is stored in one compartment and dispensed under operator control to an area adjacent the brush. The brush rotates and works the cleaning solution into the floor for removing dirt. The spent solution left on the floor behind the brush is picked up by the vacuum recovery system where it is returned to a separate tank for the spent solution.

It has become desirable in automatic floor scrubbers of the type described above, to use a squeegee which is curved so that the trailing squeegee gathers the water, rather than permitting it to roll off to the side. The squeegee is mounted so that it can rotate independently about a vertical axis (permitting the squeegee to move laterally as the machine negotiates a turn) as well as about a horizontal axis, which permits the squeegee to accommodate itself to areas of the floor which might be unlevel. In addition, for transportation between work areas or to storage, it is desirable that the squeegee be raised to a transport or nonuse position in which the squeegee is out of contact with the floor. The brush is also preferably raised during transport.

However, mechanisms for providing all of the various motion and functions of the squeegee while permitting it to track accurately behind the machine during forward motion as well as during turns and to do so by a structure which is economical to manufacture, has been difficult. Typical structures for mounting squeegees behind floor scrubbers have been expensive to manufacture and difficult to access and repair.

SUMMARY OF THE INVENTION

The present invention includes a gimbal housing which is manufactured as a unitary structure. The gimbal housing includes a vertical pivot shaft to which a yoke is mounted. The yoke swings, laterally with the vertical shaft, and it includes a rearwardly extending tubular receptacle. The squeegee assembly includes a forwardly extending tube which is telescopically received in the tubular receptacle in the gimbal housing and retained in the tubular receptacle so that the entire squeegee assembly has independent rotation about a horizontal axis and the flexible skirts of the squeegee are able to accommodate themselves to floor surfaces which may be uneven. The squeegee assembly may also be adjusted in pitch to achieve uniform pressure of the squeegee blades on the floor to avoid streaking.

The gimbal housing is, in turn, mounted by brackets which are secured to the rear of the frame of the machine and have two depending tabs for providing the trunnion mount for the gimbal housing. The trunnion mount enables the housing to rock about a horizontal axis transverse to the direction of travel.

A coil spring is tensioned between the gimbal housing and the frame to bias the gimbal housing in the use position, thus insuring effective engagement between the squeegee and the floor during use.

A lift cable is actuatable by the operator, and has its lower end connected to the gimbal housing for rotating the gimbal housing about the transverse horizontal axis to raise the squeegee to the transport position.

A pair of torsion springs are located at the top and bottom respectively of the vertical pivot shaft in the gimbal housing so that when the squeegee is raised, the torsion springs center the squeegee. Thus, in the nonuse position, the squeegee is biased toward dead-center, and this is considered desirable in that it insures that the forwardly-extending lateral ends of the curved squeegee are always disengaged from the floor during transport. The torsion springs also prevent the squeegee from waggling in the use position which reduces the wear on the blades.

Other features and advantages of the present invention will be apparent to persons skilled in the art from the following detailed description of a preferred embodiment accompanied by the attached drawing wherein identical reference numerals will refer to like parts in the various views.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
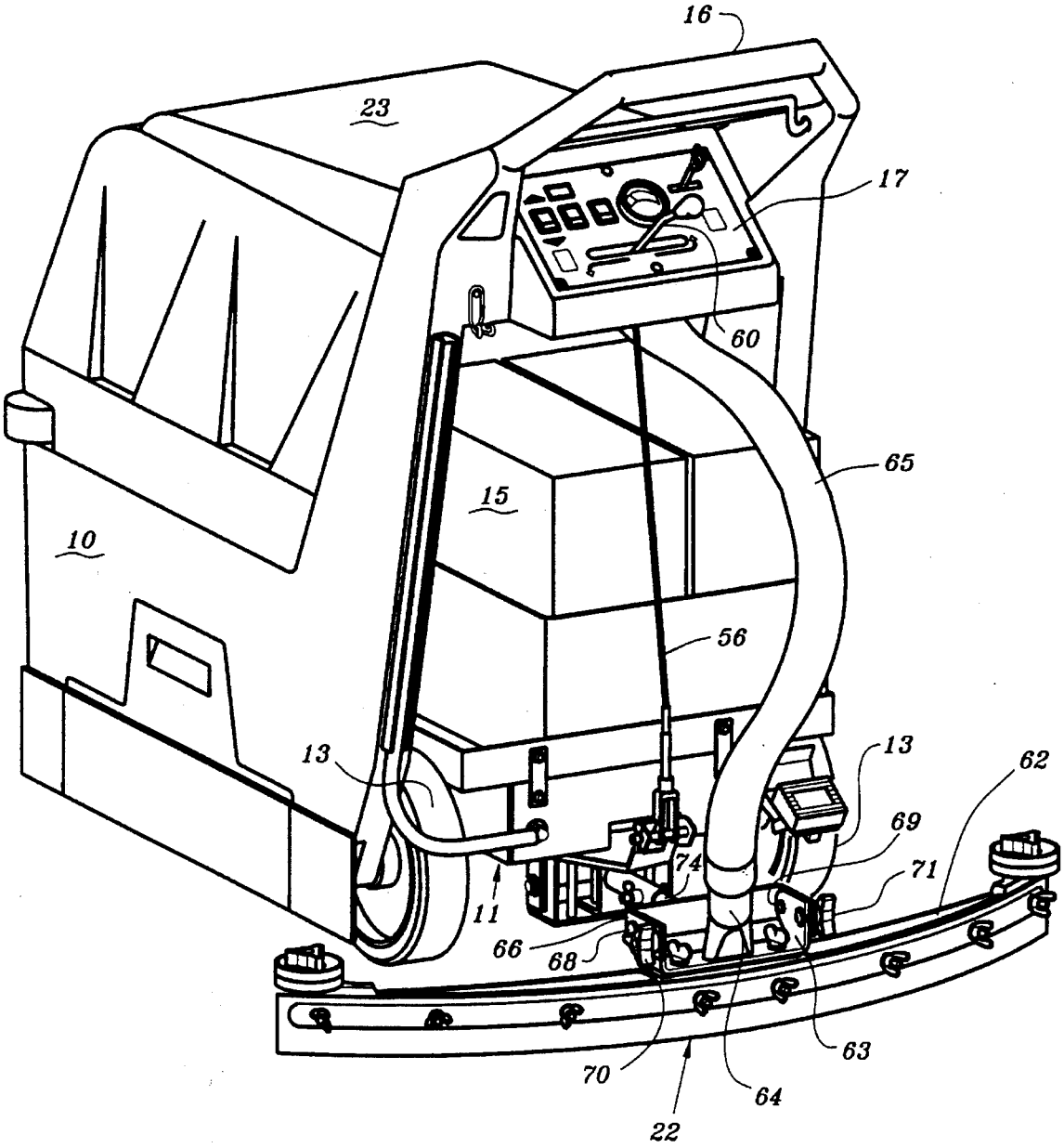
FIG. 1 is an upper rear perspective view of a floor scrubber incorporating the present invention.

FIG. 1 shows a self-propelled scrubbing machine in upper, rear perspective view, taken from the left side of the machine. The terms "left" and "right" refer to the respective sides of the machine from the viewpoint of an operator standing behind the machine and looking in the direction of forward travel. Floor scrubbers of the type illustrated are designed to clean hard-surface floors, such as wood, tile or asphalt.

Figure 2:
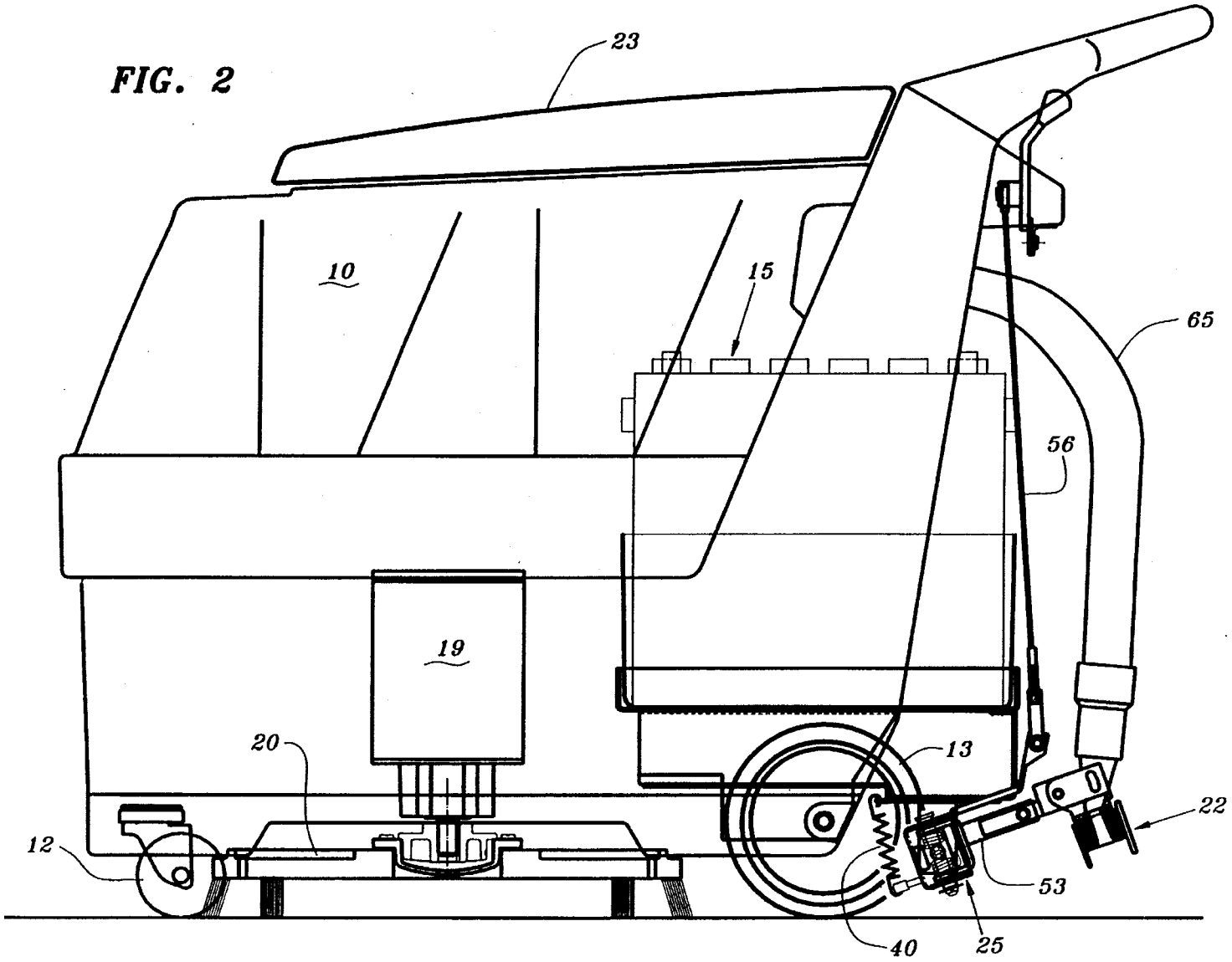
FIG. 2 is a left side elevational view of the scrubber of FIG. 1 showing the squeegee in the transport position.

The machine of FIGS. 1 and 2 includes a cover or casing 10 mounted on a frame or chassis 11 having forward wheels 12 and rear wheels 13. The illustrated scrubber is powered by batteries generally designated 15 in FIG. 2; and a conventional drive system (not shown) is powered by the batteries 15 drives the rear wheels 13 under control of the operator. The forward wheels 12 are caster-mounted for improved handling. The operator is normally positioned behind the machine, with his hands on handle 16, and he is able to operate the machine by manipulating switches and other controls on the control panel 17.

Figure 3:
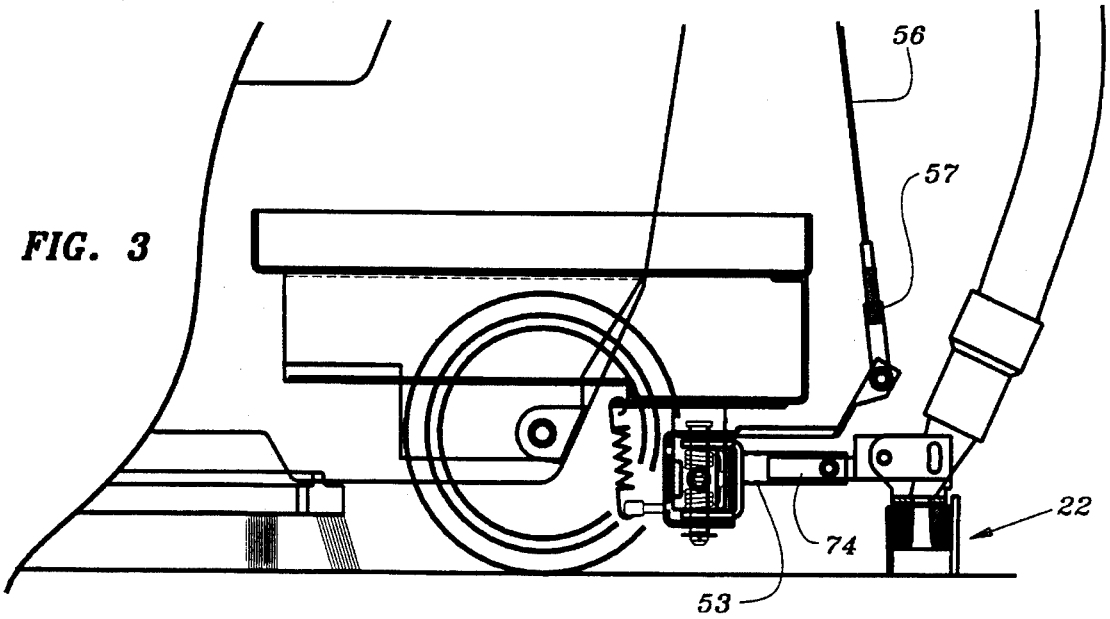
FIG. 3 is a fragmentary close up side view of the lower rear portion of the machine showing the squeegee in the use position.

A motor 19 (FIG. 2), also powered by the batteries 15, drives, under operator control, a brush 20 which rotates about a vertical axis towards the forward end of the machine. Following behind the brush is a squeegee assembly generally designated 22 in FIGS. 1–3. The squeegee assembly 22 is part of a vacuum or suction recovery system for the spent (i.e., dirty) fluid left by the brush 20.

As is conventional, cleaning solution is housed within a reservoir in the machine, and it is dispensed in an area adjacent the brush 20. The brush 20 works the cleaning solution into the floor, loosening dirt and grime. The spent solution remains on the floor as the machine passes, and the squeegee assembly, under vacuum suction, recovers the spent solution and returns it to a second chamber housed within the cover panel 10 until the recovery tank is full or the job is completed, at which time the spent solution is discarded. Both liquid chambers may be accessed y raising the lid 23.

Mounted beneath the machine and toward the rear of the machine (that is, between the rear wheels 13) is a gimbal housing 25 which is secured to the chassis of the machine by means of left and right mounting brackets 26, 27 (FIG. 4) which provide a trunnion mount, as will be disclosed below, for the gimbal housing 25. The squeegee assembly 22, then, is mounted to the gimbal housing 25 in such a manner that squeegee assembly may rotate independently about a vertical axis (permitting the squeegee to shift laterally during turns) and a horizontal axis (which permits the squeegee to accommodate itself to uneven floor levels). In addition, squeegee assembly 22 and gimbal housing 25 may be raised to a transport or nonuse position, seen in FIG. 2, and described more fully below.

Figure 4:
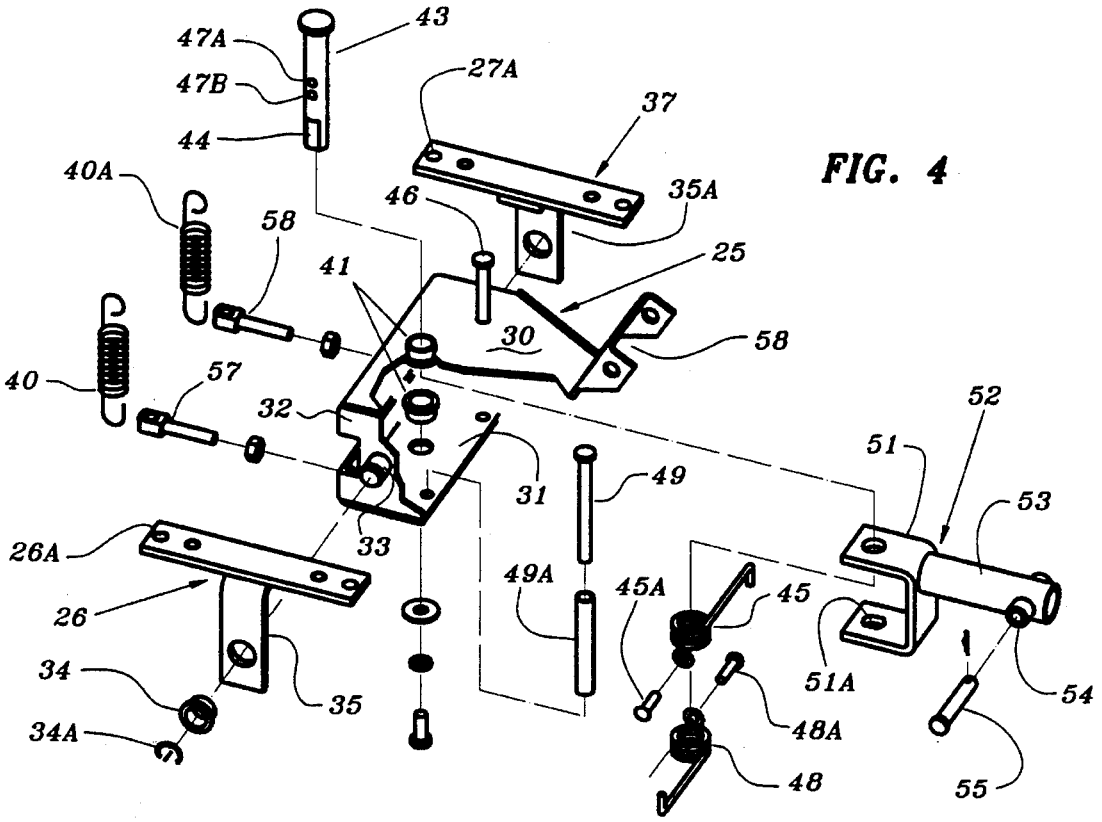
FIG. 4 is an upper rear perspective view of the gimbal housing and assembly for the machine of FIG. 1, with the parts shown in exploded relation.

Turning now to FIG. 4, the gimbal housing 25 includes a top plate 30, a bottom plate 31, and similar first and second side plates, one of which is seen in FIG. 4 and designated 32, forming a rigid, integral housing.

Integral with the sidewall 32 of the gimbal housing is a stub shaft 33 which acts as a swivel or trunnion pin when received in a bushing 34 mounted in a depending leg 35 of the gimbal mounting bracket 26 and secured by clip 34A. A similar stub shaft is provided on the right side plate of the gimbal housing, and it is received in a corresponding bushing (not shown) of a second depending leg 35A on the right mounting bracket 27. The brackets 26, 27 are mounted to the bottom of the chassis of the machine by horizontal straps seen in FIG. 4 and secured by bolts, not shown. The forward portions of the horizontal straps of mounting brackets 26, 27 include first and second apertures 26A, 27A for receiving tension springs 40, 40A seen in FIGS. 2 and 4. The purpose of this of the springs 40, 40A will be explained presently.

Returning to the gimbal housing shown in FIG. 4, a vertical center shaft 43 is journalled in a bushing 41 received aperture in the top plate 30 and secured by a threaded bolt 42 similarly journalled by a bushing 41 in the bottom plate 31 of the gimbal housing. The lower portion of the shaft is flattened as at 44, and its midsection includes two apertures 47A and 47B.

A first torsion coil spring 45 is received on the top of the shaft 43. Spring 45 has one end looped and secured to the shaft by a pin 45A received in aperture 47A of the shaft 43. The other end of spring 45 extends outwardly to the right and in front of screw 46 secured between the top plate 30 and bottom plate 31. A similar torsion spring 48 is received on the bottom of the shaft 43. Again, one end of the torsion spring 48 is looped and secured to the shaft 43 by screw 48A in aperture 47B of the shaft. The other end of spring 48 extends to the left and is in front of a screw 49 secured between the top and bottom plates of the housing, as illustrated in FIG. 4. Sleeves, such as the one designated 49A for screw 49, may be placed over these screws to permit free action of the springs. The torsion springs 45, 48 are preloaded and arranged to turn the shaft 43 in opposing rotational directions, and they thus act to center the shaft 43 while permitting the shaft (and squeegee assembly) to shift laterally. The ends of springs 45, 58 may disengage their respective sleeve/screw limits when the squeegee assembly rotates toward the limits of its range.

The flattened segment 44 of the shaft 43 is received in corresponding hole 51A in the lower leg of a bifurcated base 51 of a yoke 52. Connected to the base 51 is a tubular receptacle 53 which contains an aperture 54 receiving a pin and securing the squeegee assembly, as will be described presently. The flattened segment 44 of the shaft received in a corresponding aperture "flattened" in the yoke 52, provides a driving relationship between the shaft 43 and the yoke 52. In other words, when the squeegee moves laterally away from the center position, for example, when the scrubber makes a turn, then the friction between the floor and the squeegee pick-up causes the yoke to rotate about a vertical axis, and thereby drive the shaft 43 in rotation. When the shaft 43 is rotated, the torsion springs will be tensioned to create a bias to force the yoke (and, thus, the squeegee) back to the center position. When the squeegee is raised (as well as in the use position), the torsion springs will both create a bias on the shaft 43 to cause it to be centered, and when the shaft 43 rotates to the center position, it will drive the yoke 52 and the squeegee to the center position behind the machine.

The arrangement of swivel pins 33 and bushings 34 permit the gimbal housing to rotate about a horizontal axis which extends transverse of the direction of travel of the machine; and this vertical rotary movement of the gimbal housing is independent of the angular location of the yoke 52. This permits the squeegee to be raised to the transport position irrespective of the position of the squeegee at the time the machine is placed in the transport mode. The independent lateral and vertical movement of the squeegee allows it to follow the contour of uneven floor surfaces during its normal "use" position-for example, turning on a sloped surface.

Raising of the squeegee is accomplished by means of a lift cable 56 which is secured at its lower end by means of a U-shaped coupler 57 to an upwardly extending tang 58 of the top plate 30 of the gimbal housing (FIG. 4). The upper end of the lift cable 56, as is conventional, is connected to a crank arm attached to a lever 60 mounted adjacent to the control panel 17 so that when the operator moves the lever 60 left or right, the crank 55 rotates between a lowered and a raised position, and thereby lifts the squeegee assembly by means of the lift cable 56. When the lever 60 is turned to the lowered position, thereby releasing tension on the lift cable 56, the coil springs 40, 40A of FIG. 8 cause the gimbal housing 25 to rotate to the lowered or use position because the lower ends a partial front section of the springs 40,40A are connected to retainer pins 57, 58 mounted to the gimbal housing.

The squeegee assembly 22 includes a central casting 62 (FIG. 1) at the top of which is mounted a U-shaped bracket 63. A hose adapter 64 is mounted to the bracket 63 and communicates with the chamber of the casting 62 to evacuate the casting. A vacuum hose 65 is connected to the adapter 64 and couples the squeegee to a suction compartment in the machine, as is known in the art.

A pitch adjusting bracket 66 is secured to the upright flanges on the tube bracket 63 by means of a pair of forward pins 68, 69 and a pair of rear screws provided with knobs 70, 71. The pitch adjusting bracket 66 has a pair of vertically extending slots receiving the screws attached to the knobs 70, 71 so that the tube bracket 63 can be rotated about the forward pins 68, 69 until it is flush on the floor, and then the knobs 70, 71 are tightened.

At the forward end of the pitch bracket 66 is a tubular extension 74 which is telescopically received in the previously-described tubular receptacle 53 of the yoke. Pin 55 extends through the receptacle 53 and the forward extension 74 of the pitch bracket 66 in a loose fit. This retains the extension 74 in the receptacle 53, while permitting the squeegee assembly to rotate slightly about a horizontal longitudinal axis and thereby permit the squeegee to adjust to variations in the level of the surface being treated.

In summary, the structure disclosed for mounting the squeegee assembly behind a floor scrubbing machine of the type described, permits the squeegee to have independent rotation about a vertical axis (defined by the shaft 43 of the gimbal housing) as well as a longitudinal horizontal axis indicated by the line 28 in FIG. 1. The first motion permits the squeegee to move laterally, for example, when the machine turns. As the machine continues in a straight following a turn, the torsion springs acting on the vertical shaft in the gimbal housing center the squeegee assembly.

When it is desired to raise the squeegee to a nonuse position, the lift cable simply elevates the entire gimbal housing about the trunnion mount provided by the gimbal mounting brackets. This is permitted irrespective of the lateral position of the squeegee, and the squeegee will be returned under action of the torsion springs, to the center position when it is raised for transport. Moreover, and this is considered an important feature of the present invention, which can best be appreciated from FIG. 1, the entire gimbal mounting structure is simple and located right at the rear of the machine, substantially between the rear wheels with the axis of the trunnion mount in substantial vertical alignment with the axis of the rear drive wheels; and the gimbal housing, formed into a unitary assembly, is manufactured as reduced cost and quickly and conveniently assembled to its associated mounting bracket which is mounted by conventional assorted fasteners to the frame of the machine. The rear, simple mounting structure also permits easy access for maintenance or repair.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In combination with a floor scrubber having a frame, a powered brush mounted on said frame for working cleaning solution into a floor, and suction means including a squeegee assembly behind the brush for recovering spent liquid, an improved mounting assembly for said squeegee comprising:

a mounting bracket mounted beneath said frame at the rear of said machine;

a gimbal housing mounted beneath the frame of said machine and adjacent the rear thereof, said gimbal housing mounting to said bracket for rotation about a transverse horizontal axis;

a yoke mounted to said gimbal housing for rotation about a vertical axis and including a rearwardly extending first member adapted for swinging motion in a horizontal plane;

said squeegee assembly including a forwardly-extending second member;

means for coupling said second tubular member of said squeegee assembly to said first member of said gimbal housing to permit rotation of said squeegee assembly about a horizontal axis parallel to the direction of travel of said machine when said squeegee assembly is centered for adjusting to uneven surfaces.

first spring means connected between said machine of said frame and said housing for biasing the rear end of said housing in a downward direction to apply a downward force on said squeegee assembly;

second spring means carried in said housing for urging said yoke toward the centered position thereof; and means on said housing for receiving a lift cable, whereby when said lift cable is raised vertically, said housing pivots about said first pivot axis against the bias of said first spring means to raise said squeegee assembly and said second pivot means to a nonuse position above the floor.

2. The apparatus of claim 1 wherein said gimbal housing includes a rearwardly-extending plate having a distal end remote from the horizontal axis of rotation of said housing, and wherein said machine includes a lift cable having one end connected to the distal end of said plate of said gimbal housing, and the other end is under control of the operator of said machine for selectively raising said gimbal housing to a nonuse position by pulling upwardly on the distal end of plate of said housing and thereby rotating said gimbal housing about said transverse horizontal axis, whereby said squeegee is elevated out of contact with the floor; and first spring means connected between said frame and said gimbal housing for biasing said gimbal housing in rotation about said transverse horizontal axis to urge said squeegee assembly into contact with the floor.

3. The apparatus of claim 2 further comprising second spring means connected between said yoke and said gimbal housing for biasing said yoke in a normal, centered position in which said first member of said yoke extends generally along the center line of said machine in the direction of travel, while permitting said squeegee assembly to move laterally to either side of said machine.

4. The apparatus of claim 3 further comprising a vertical shaft in said gimbal housing; and means for coupling said yoke in driving relation with said vertical shaft, where said second spring means comprises at least one torsion spring connected to said vertical shaft and having an outwardly extending end and anchored to said gimbal housing.

5. The apparatus of claim 1 wherein said gimbal housing comprises a top plate, a bottom plate, and first and second side plates formed into an integral, rigid housing, said top plate extending rearwardly to a distal end; and said apparatus further includes a lift cable under control of the operator of said machine having one end connected to the distal end of said top plate of said housing for raising said housing and said squeegee assembly to a non-use position out of contact with the floor.

6. The apparatus of claim 5 further comprising a shaft mounted between the top and bottom walls of said gimbal housing and having a center section in driving relation with said yoke; and further including torsion spring means for biasing said shaft to a position in which said first tubular member extends along the centerline of said machine in the direction of travel.

7. The apparatus of claim 6 wherein said side plates of said gimbal housing each include an outwardly extending stub shaft; and wherein said mounting bracket includes first and second depending legs coupled respectively to the first and second stub shafts of said sidewalls of said gimbal housing to provide a trunnion mount for said gimbal housing.

8. The apparatus of claim 7 further comprising a pitch adjusting bracket on said squeegee assembly for mounting said squeegee to said second member while permitting adjustment of the pitch of said squeegee assembly.

9. In combination with a floor scrubbing machine having a frame, a powered brush mounted on said frame in a forward position for working cleaning solution into a floor to be treated, and suction means including a squeegee assembly behind said brush for recovering spent liquid from the floor, an improved mounting assembly for said squeegee comprising:

a mounting bracket mounted beneath said frame at the rear of said frame and including first and second downwardly depending legs, the lower portion of each leg providing a journal for defining a trunnion mount;

a gimbal housing having a top plate, first and second side plates and a bottom plate connected together to form a rigid, integral housing, said top plate extending rearwardly to a distal end, said first and second side plates each including an outwardly-extending stub shaft received respectively in the journals of said first and second depending legs of said mounting bracket, whereby said housing is trunnion-mounted to said bracket;

first spring means connected between said frame and said gimbal housing for urging said squeegee assembly to use position;

a shaft mounted vertically in said housing;

second spring means for centering said yoke while permitting said yoke to rotate about a vertical axis;

a yoke mounted to said shaft and extending rearwardly thereof;

and means for mounting said squeegee assembly to said yoke while permitting said squeegee assembly to rotate about a horizontal axis defined by said yoke, whereby said squeegee may accommodate itself to variations in floor level.

10. The apparatus of claim 9 said squeegee is characterized as being curved such that its ends extend forwardly of the center section thereof, said apparatus further including a lift cable under operator control having a lower end connected to the distal end of said top plate of said gimbal housing, whereby said gimbal housing and said squeegee assembly may be elevated to a raised position wherein said second spring means act to center said squeegee assembly behind said housing to insure that the forward ends of the curved squeegee are out of engagement with the floor.

* * * * *